United States Patent [19]

Kolb

[11] 4,046,486

[45] Sept. 6, 1977

[54] LUBRICATION OF FAN BLADE BEARINGS

[75] Inventor: Werner Bernard Kolb, Zweibruecken, Germany

[73] Assignee: Turbo-Lufttechnik GmbH, Zweibrucken, Germany

[21] Appl. No.: 602,358

[22] Filed: Aug. 6, 1975

[30] Foreign Application Priority Data

July 8, 1974 Germany ..... 2437932

[51] Int. Cl.[2] ..... F04D 29/36

[52] U.S. Cl. ..... 416/157 R; 416/146 A; 416/174

[58] Field of Search ..... 416/146 A, 174, 157, 416/157 A

[56] References Cited

U.S. PATENT DOCUMENTS

| | | | |
|---|---|---|---|
| 1,510,436 | 9/1924 | Englesson | 416/174 X |
| 2,028,448 | 1/1936 | Harza | 416/174 X |
| 2,283,128 | 5/1942 | Ring | 416/157 |
| 2,987,123 | 6/1961 | Liaaen | 416/157 |
| 3,245,497 | 4/1966 | Yokoi | 416/174 X |
| 3,301,330 | 1/1967 | Covert | 416/174 X |
| 3,325,088 | 6/1967 | Keen et al. | 416/174 X |
| 3,339,639 | 9/1967 | Elmes et al. | 416/157 X |
| 3,395,763 | 8/1968 | Avena et al. | 416/157 X |
| 3,603,698 | 9/1971 | Jensen | 416/157 |

FOREIGN PATENT DOCUMENTS

| | | | |
|---|---|---|---|
| 116,880 | 9/1945 | Australia | 416/157 |
| 947,583 | 7/1949 | France | 416/157 |
| 1,256,667 | 2/1961 | France | 416/174 |
| 1,285,127 | 1/1962 | France | 416/157 |
| 1,128,780 | 4/1962 | Germany | 416/157 |

*Primary Examiner*—Everette A. Powell, Jr.

*Attorney, Agent, or Firm*—Joseph M. Maguire; Robert J. Edwards

[57] ABSTRACT

A method and apparatus for lubricating the bearings associated with rotor mounted variable pitch type blades in axial flow fans.

6 Claims, 1 Drawing Figure

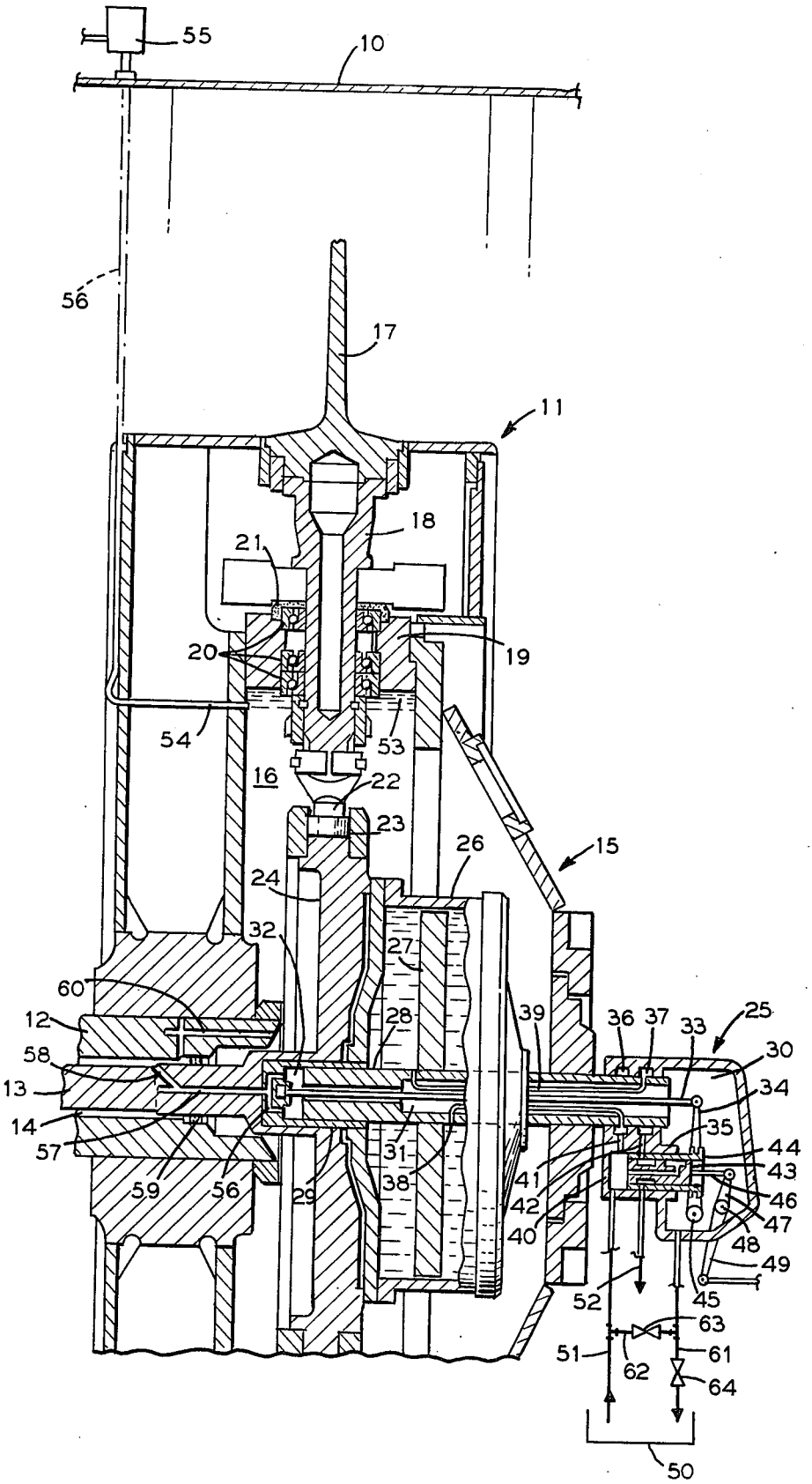
55
10
56
17
11
18
21
20
19
54
53
16
22
23
26
15
24
32
27
60
12
28
39
36
37
33
25
58
30
13
34
14
35
57
44
31
43
59
56
29
38
41
46
42
47
40
48
49
52
45
63
51
61
62
64
50

LUBRICATION OF FAN BLADE BEARINGS

BACKGROUND OF THE INVENTION

The present invention relates generally to axial flow fans having variable pitch blading and particularly to the lubrication of anti-friction type bearings used in mounting the blades to the fan rotors.

In the type of fan under consideration, the quantity of air being delivered by the fan is controlled by angularly shifting the blades about their central axes. It is advantageous to minimize the force required to shift the blades during operation in order that the variable pitch blade drive be of reasonable dimensions while retaining some reserve capacity. Accordingly, one should use anti-friction type bearings when mounting the blades to the fan rotor even though the infrequent and relatively small movement required of these blades is not a normal application for these type bearings. Such application has led to malfunctions of the bearings and associated lubrication systems and has resulted in rapid increases in blade shifting forces to values exceeding the drive motor rating. Moreover, difficulty has been encountered in the selection of lubricants and lubricant seals for anti-friction type bearings when subjected to the centrifugal forces and varying temperatures experienced during operation of the fans. Grease type lubricants have been found to breakdown under these operating conditions and have resulted in the loss of oil contained in the grease thereby leaving a residue inadequate for lubrication. Difficulty has also been encountered with providing effective long term lubricant seals for these bearings, thus leakage of lubricant in varying quantities can be expected over the service life of the equipment.

SUMMARY OF THE INVENTION

Accordingly, it is an object of the present invention to increase the service life of variable pitch blade type axial flow fans by providing an improved method and apparatus for lubricating the bearings associated with the fan blades.

The invention achieves this object by introducing lubricating oil into the interior of the fan rotor so that, as the rotor turns, the oil will be centrifugally displaced to form an annular oil layer against a ring which supports the blade bearings and will be caused to penetrate these bearings from within the rotor. Thus, oil loss due to ineffective sealing of the bearings is immediately replenished by oil penetrating from the annular oil layer, thereby insuring adequate lubrication at all times. Consequently, the bearing seals need not remain fluid tight since any escaping oil is immediately replaced by oil entering the bearings from the annular oil layer. This continuing supply of lubricant prevents excessive rises in the required blade shifting forces while also protecting the blade bearings against damage resulting from inadequate lubrication.

In accordance with the invention, one embodiment allows the addition of lubricant during operation and shutdown of the rotor. This embodiment is associated with a hydraulic drive used to control the pitch of the blades and makes use of certain components of the drive to convey the lubricating oil, which is preferably the same as the hydraulic fluid, to the interior of the turning rotor. Those drive components which also serve to replenish the supply of lubricant for the blade bearings are suitably drilled to form passages which cooperate with like passages in the drive shaft to form a path for the flow of lubricant to the interior of the rotor. A conduit is provided which communicates with a chamber in the drive and which is interconnected with the hydraulic fluid supply line to deliver pressurized lubricant to the chamber for introduction to the passages leading to the interior of the rotor.

Another embodiment provides conduits for supplying lubricant to the interior of the rotor while the latter is stationary.

BRIEF DESCRIPTION OF THE DRAWING

The drawing is a section side view of the second stage of a two stage axial flow fan embodying the invention.

DETAILED DESCRIPTION OF THE PREFERRED EMBODIMENTS

The drawing illustrates a portion of a fan housing 10 and a section of the second stage 11 of a two stage axial flow fan. The two stages are supported by a main bearing shaft 12 and the variable pitch blading is controlled from a control shaft 13 which extends through a central bore 14 of the drive shaft 12.

Since the arrangement and support of the variable pitch fan blade structure is substantially the same for both stages, it will suffice to describe the structure corresponding to the second stage 11.

Accordingly, each of the stages includes a rotor 15 which is formed with an inner chamber or cavity 16. The rotor 15 is fitted with a plurality of circumferentially equispaced variable pitch blades, one of which is fragmentarily shown at 17. The blades are shiftable to and fro about their central axes, within the area of a quadrant, to meet the range of load demand on the fan. The shifting structure includes having each blade 17 provided with a shank 18 which lies within the rotor 15 and extends through a corresponding rim opening in a ring 19 and is shiftingly supported therefrom by a stack of ball bearings 20. An annular plate 21 fits around the shank 18 and forms an oil seal cover over the ball bearing stack, the seal cover 21 need not be completely fluid tight. The shank 18 has its free end connected to a lever 22 which is in turn slidably engaged with a circumferential groove 23 formed along the rim of an axially movable cam 24. The cam 24 of the second stage and a like cam of the first stage are rigidly interconnected by the control shaft 13 of a common hydraulic positioning device 25 and move as one unit.

The angular position of all the blades 17 of both stages is simultaneously adjusted by the common hydraulic positioning device or drive 25 which includes a reciprocable cylinder 26 connected to the cam 24 of the second stage 11. The cylinder 26 houses a stationary piston 27 mounted on a fixed tubular member 28 which extends through the cylinder 26 and has one end seated in a cap 29 fitted within the cam 24, and the other end extending into a chamber 30 located outside of the rotor 15. The tubular member 28, the piston 27, the cylinder 26 and the cam 24 rotate as a unit with the rotor 15. The tubular member 28 has a center bore 31 which defines a passage between the chamber 30 and a chamber 32, the latter is formed by the cap 29 and an end face of tubular member 28 and varies in capacity with changes in cylinder position. The bore 31 is traversed by a reciprocable rod 33 which has one end connected to a lever 34, located within the chamber 30, and the other end connected to the cap 29.

The chamber 30 includes an end section 35 which receives the tubular member 28 and includes a pair of annular passages 36 and 37 in surrounding relation therewith. Suitable means, not shown, are provided for maintaining a substantially fluid tight fit where the rotating tubular member 28 penetrates the end section 35. The passages 36 and 37 communicate with opposite sides of the piston 27 through corresponding conduits 38 and 39 extending through the wall and bore of the tubular member 28. The end section 35 also includes a cylinder bore 40 which communicates with the annular passages 36 and 37 through corresponding passages 41 and 42. The cylinder bore 40 houses a reciprocable piston 43 and a reciprocable slide valve 44 in surrounding relation to the piston 43. The slide valve 44 is connected to the lever 34, and the latter is pivoted on a shaft 45. The piston 43 is connected through a rod 46 to a lever 47 and the latter is pivoted on a shaft 48 which extends out of the chamber 30 and is connected to a lever 49 for movement by an actuator, not shown, in response to load demand on the fan. The cylinder bore 40 is connected to an oil sump 50 through supply and return conduits 51 and 52, respectively. The supply conduit 51 includes a pump, not shown, which delivers the oil pressure required in the operation of the hydraulic positioning drive 25.

During operation of the fan, pressurized oil is available at the discharge end of conduit 51. The piston 43 controls the distribution of pressurized oil to passages 41 and 42 according to the position which it assumes in response to load demand on the fan. The flow of oil continues through the selected passage, with the other passage acting as a return, until the desired blade position is attained and at which time the slide valve 44 will have moved back into starting position so as to shut off the flow of oil to and from passages 41 and 42. The pressurized oil located in the space formed by cylinder bore 40, between adjacent end faces of the section 35 and the piston 43 and slide valve 44, exerts a minor force in the direction of chamber 30, i.e., about one percent of the force being exerted on piston 27. The mechanism comprising elements 33, 34, 45, 46, 47, 48 and 49 is designed to absorb these forces. When the chamber 30 is pressurized to add lubricating oil to cavity 16, the pressurized oil within chamber 30 exerts a force on adjacent end faces of piston 43 and slide valve 44 which counteracts the force exerted on the end faces opposite thereto and results in a reduction of the minor force acting on the piston 43 and slide valve 44.

The drawing shows the hydraulic positioning drive 25 in the process of adjusting the angular position of the blades 17. The piston 43 and the slide valve 44 are drawn by their respective levers 34 and 47 to a position which opens the passage 41 to the supply conduit 51 and the passage 42 to the return conduit 52, and allows pressurized oil to flow through the passages 41 and 36 and through the conduit 38 into the right-hand side of cylinder 26 thereby causing the latter to shift toward the outboard end of the rotor 15. The oil within the left-hand side of the cylinder is forced out through conduit 39 and passages 37 and 42 and through the return conduit 52 to the oil sump 50. The shifting of cylinder 26 is translated through the cap 29 to the rod 33 and the latter is connected to the lever 34 which controls the position of slide valve 44.

The apparatus of the present invention insures that there is always adequate lubrication of the ball bearings 20 associated with the variable pitch fan blades 17. Accordingly, there is provided apparatus for introducing lubricating oil to the rotor inner chamber 16 so that during operation of the fan, the lubricant contained in the rotating cavity 16 is centrifugally displaced and forms an annular layer 53 against the inner circumferential periphery of the ring 19. The centrifugal forces cause the oil to penetrate the stack of ball bearings 20 thereby lubricating the bearing surfaces and replenishing the oil which will have leaked out from between the seal cover 21 and the blade shank 18 and/or ring 19.

A main embodiment of the invention provides apparatus whereby the lubricating oil can be introduced into the inner chamber 16 during operation of the rotor 15. The apparatus is shown operatively associated with certain sections of the positioning drive 25, however, it should be recognized that other devices may be substituted for these sections. In accordance with this embodiment, the oil employed with the hydraulic positioning drive 25 is the same type as that used to lubricate the ball bearings 20. The apparatus includes having the cap 29 formed with bores or passages 56 which communicate with a central bore or passage 57 formed within an adjoining portion of the control shaft 13. The passage 57 branches-off into one or more lateral bores or passages 58 which communicate with the central bore or passage 14 of the drive shaft 12. The passage 14 can communicate with the rotor cavity 16 through spaces formed by the play of the guide bushings 59 interposed between the shafts 12 and 13. The rotor end of the drive shaft includes one or more bores or passages 60 connecting the central passage 14 with the cavity 16. The apparatus also includes a lubricating oil supply conduit 61 connecting the chamber 30 with the sump 50 and a crossover conduit 62 connecting the hydraulic oil supply conduit 51 with the conduit 61. The crossover conduit 62 includes a normally closed valve 63 and the lubricating oil supply conduit 61 includes a normally open valve 64.

When it becomes necessary to add lubricating oil to the cavity 16, while the fan rotor 15 is turning, the valve 64 is closed and the valve 63 is opened to allow pressurized oil to flow through the crossover conduit 62 and the supply conduit 61 into the chamber 30. The oil from chamber 30 enters the passage 31 and flows therethrough to the chamber 32 and thence successively through the passages 56, 57 and 58 into the rotor shaft center bore or passage 14. The lubricating oil in the passage 15 flows into the rotor cavity 16 through the passage 60 and the spaces formed by the play of the guide bushings 59. Lubricating oil also flows through the drive shaft center bore passage 15 and through one or more bores or passages, similar to that shown at 60 but formed at the other end of the shaft 12, and into the cavity of the first stage rotor, not shown.

An alternate embodiment of the invention provides apparatus whereby a conduit 54 extends from the circumferential periphery of the rotor 15 to the cavity 16 and is used to introduce lubricating oil into the cavity 16 while the rotor 15 is shutdown. A pump 55 is located on the outside of the fan housing 10 and is connected with the feed conduit 54 through a movable crossover conduit 56 temporarily installed during shutdown of the rotor 15 to allow oil to be passed from the outlet of pump 55 to the inlet of conduit 54.

While in accordance with the provisions of the statutes there is illustrated and described herein a specific embodiment of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. In combination with an axial flow fan having a housing, at least one rotor disposed within said housing and secured to a rotatable drive shaft formed with a center bore, a control shaft extending through the bore in spaced relation to the drive shaft, wall means defining a cavity within said rotor, blades mounted on the rotor, each of said blades being adapted to be angularly shifted about its central axis and including being fitted with a shank extending through a peripheral section of said wall means, bearing means interposed between said shank and peripheral wall section, a hydraulic device for shifting said blades, and wherein the control and drive shafts and the hydraulic device define a means for conveying a fluid lubricant into said cavity, the conveying means including the hydraulic device having an inlet and an outlet chamber, a fixed open ended tubular member interposed between and communicating with said inlet and outlet chambers, the outlet chamber having a perforated wall, and the control and drive shafts being formed with passages communicating with the center bore and with the rotor cavity and through the perforated wall with said outlet chamber, and valved conduit means connecting the inlet chamber with a source for supplying lubricant through the conveying means to said cavity, said lubricant being centrifugally displaced during rotation of the rotor to form a fluid layer against said peripheral wall section thereby providing a continuous supply of lubricant for said bearing means.

2. The combination according to claim 1 wherein hydraulic fluid for said device originates from the lubricant source, and including conduit means for supplying the hydraulic fluid to said device.

3. The combination according to claim 2 including valved conduit means interconnecting said hydraulic fluid and lubricant supply conduit means.

4. The combination according to claim 1 including guide bushings interposed between the control and drive shafts, the bushing having sufficient play to allow the passing of lubricant from the center bore to said cavity.

5. The combination according to claim 1 including a lubricant feed conduit having an inlet end communicating with the outside of the rotor and an outlet end communicating with said cavity.

6. The combination according to claim 5 including a lubricant pumping device disposed outside of the housing and a removable conduit means connecting the pumping device with the feed conduit inlet for admitting lubricant to said cavity when the rotor is shut down.

* * * * *